US006942510B2

(12) United States Patent
Nakamura

(10) Patent No.: US 6,942,510 B2
(45) Date of Patent: Sep. 13, 2005

(54) CONNECTOR AND A CONNECTOR SYSTEM

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/954,062

(22) Filed: Sep. 29, 2004

(65) Prior Publication Data

US 2005/0074997 A1 Apr. 7, 2005

(30) Foreign Application Priority Data

Oct. 1, 2003 (JP) ..... 2003-343563

(51) Int. Cl.[7] ..... H01R 29/00
(52) U.S. Cl. ..... 439/188; 439/489
(58) Field of Search ..... 439/188, 488, 439/489, 490, 595; 200/51.1

(56) References Cited

U.S. PATENT DOCUMENTS 6,036,515 A * 3/2000 Nakamura ..... 439/188
6,171,124 B1 * 1/2001 Kojima ..... 439/188
6,186,805 B1 * 2/2001 Krishnaswamy et al. ... 439/188
6,520,786 B2 * 2/2003 Nakamura et al. ..... 439/188
6,575,775 B2 * 6/2003 Hasegawa et al. ..... 439/188
6,659,785 B2 * 12/2003 Nakamura et al. ..... 439/188

FOREIGN PATENT DOCUMENTS

JP 2003-217764 7/2003

* cited by examiner

*Primary Examiner*—Hien Vu
(74) *Attorney, Agent, or Firm*—Gerald E. Hespos; Anthony J. Casella

(57) ABSTRACT

An accommodating chamber (17) is provided in a male housing (11) for accommodating a shorting terminal (90) that shorts male terminal fittings (70). A retainer mount hole (16) is formed in one side surface of the male housing (11) and communicates with the accommodating chamber (17). The retainer mount hole (16) is configured to permit entry of the shorting terminal (90) into the accommodating chamber (17) laterally along a connecting direction (CD). The accommodating chamber (17) has first and second engaging portions (17A, 17B) for holding a base plate (94) of the shorting terminal (90) while positioning it at its front and rear positions with respect to the connecting direction (CD).

9 Claims, 10 Drawing Sheets

CONNECTOR AND A CONNECTOR SYSTEM

BACKGROUND OF THE INVENTION

1. Field of the Invention

The invention relates to a connector with a shorting terminal.

2. Description of the Related Art

Japanese Unexamined Patent Publication No. 2003-217764 and FIG. 10 herein disclose a connector with a shorting terminal. With reference to FIG. 10, the connector has a male housing 1 with a terminal accommodating portion 2 and a receptacle 3 that projects forward from the terminal accommodating portion 2. Male terminal fittings 4 are inserted into cavities 5 that penetrate the terminal-accommodating portion 2 along forward and backward directions. A shorting-terminal accommodating chamber 6 is formed above the cavities 5 and is open in the back end surface of the receptacle 3. A shorting terminal 7 is mounted in the shorting terminal accommodating chamber 6 and is held resiliently in contact with the male terminal fittings 4 to short adjacent male terminal fittings 4 before the male housing 1 is connected to a female housing. On the other hand, the female housing has a canceling portion that engages the shorting terminal 7 and cancels the shorting state with the male terminal fittings 4 as the male and female housings are connected.

The shorting terminal 7 is inserted into the shorting-terminal accommodating chamber 6 from the front of the receptacle 3. The upper surface of the shorting-terminal accommodating chamber 6 has a locking projection 8 that engages a locking hole 9 in the shorting terminal 7 to prevent forward displacement of the shorting terminal 7.

The locking projection 8 has a slanted front surface 8A that reduces the inserting resistance of the shorting terminal 7 into the shorting terminal accommodating chamber 6. Thus, backward displacements of the shorting terminal 7 cannot be prevented as well as forward displacements. Further, the locking projection 8 is formed by molds that are removed via front and rear mold-removal holes 6A. The positions and the number of the locking projections 8 are restricted by the structural requirements of the mold removal holes 6A, and several locking projections 8 at front and rear positions often are structurally unfeasible. As a result, the shorting terminal 7 cannot be held in the male housing 1 with a sufficient force, and there is a danger that the shorting terminal 7 will displace or unlock when engaged by the male terminal fittings 4 or the canceling portion.

The present invention was developed in view of the above problems and an object thereof is to securely hold a shorting terminal.

SUMMARY OF THE INVENTION

The invention relates a connector with a housing and a plurality of terminal fittings inserted into the housing. An accommodating chamber is formed in the housing and accommodates a shorting terminal. The shorting terminal normally contacts and shorts at least some of the terminal fittings. However, a shorting state is canceled when the connector is connected with a mating connector. At least one positioning portion is provided in the accommodating chamber for holding the shorting terminal and positioning the shorting terminal at its front and rear positions with respect to a connecting direction of the connectors. A window is formed in a side surface of the housing and communicates with the accommodating chamber to permit entry of the shorting terminal into the accommodating chamber. The window enables the formation of the positioning portions. Thus, the shorting terminal can be held securely while being positioned at its front and rear positions with respect to the connecting direction.

The shorting terminal preferably includes a base plate. Shorting pieces are provided at one end of the base plate and extend substantially along an inserting direction of the terminal fittings. A deformation space is formed between the shorting pieces and the base plate for permitting resilient deformation of the shorting pieces. The base plate has a resiliently deformable lock that projects towards a side substantially opposite the deformation space. The lock extends obliquely to an entering direction of the shorting terminal into the accommodating chamber. A receiving portion is provided on the inner surface of the accommodating chamber of the housing for engaging the lock. Thus, the shorting terminal does not come out of the accommodating chamber.

The base plate preferably has an elevated portion projecting towards the deformation space. The lock that projects into and the receiving portion preferably enters an elevation space inside the elevated portion. The lock projects towards the side opposite the deformation space. Thus, the height of the housing would increase to enlarge the connector if the receiving portion was offset from the deformation space by a distance conforming to a projecting amount of the lock. However, the elevated portion projects towards the deformation space and the lock projects into the elevation space. Thus, the receiving portion is raised towards the deformation space and the connector is not enlarged.

The lock of the shorting terminal preferably is resiliently deformed and slides on the receiving portion as the shorting terminal is inserted into the accommodating space.

The base plate may have an inclined portion sloped up towards the deformation space. The lock may be provided at the inclined portion, and the receiving portion may be provided along the inclined portion. Thus the position of the receiving portion is raised towards the deformation space and follows the lock on the inclined portion. Accordingly, the connector is not enlarged.

The window preferably can be at least partly covered by a lid. The lid may include a covering portion for at least partly covering the window and at least one lock for locking the terminal fittings in the housing. Most preferably, the window can be closed fully by the lid. Thus, the lid protects the shorting terminal from external matter.

The invention also relates to a connector system comprising the above-described connector and a mating connector. The mating connector has at least one canceling portion for canceling a shorted state of the terminal fittings by the shorting terminal when the two connectors are connected.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A male connector according to a first embodiment of the invention is identified generally by the numeral 10 in FIGS. 1 to 8. The connector 10 is connectable to a female connector 20 to form part of the airbag activating circuit of an automotive vehicle. In the following description, engaging sides of the male and female connectors 10, 20 are referred to as the fronts.

Figure 1:
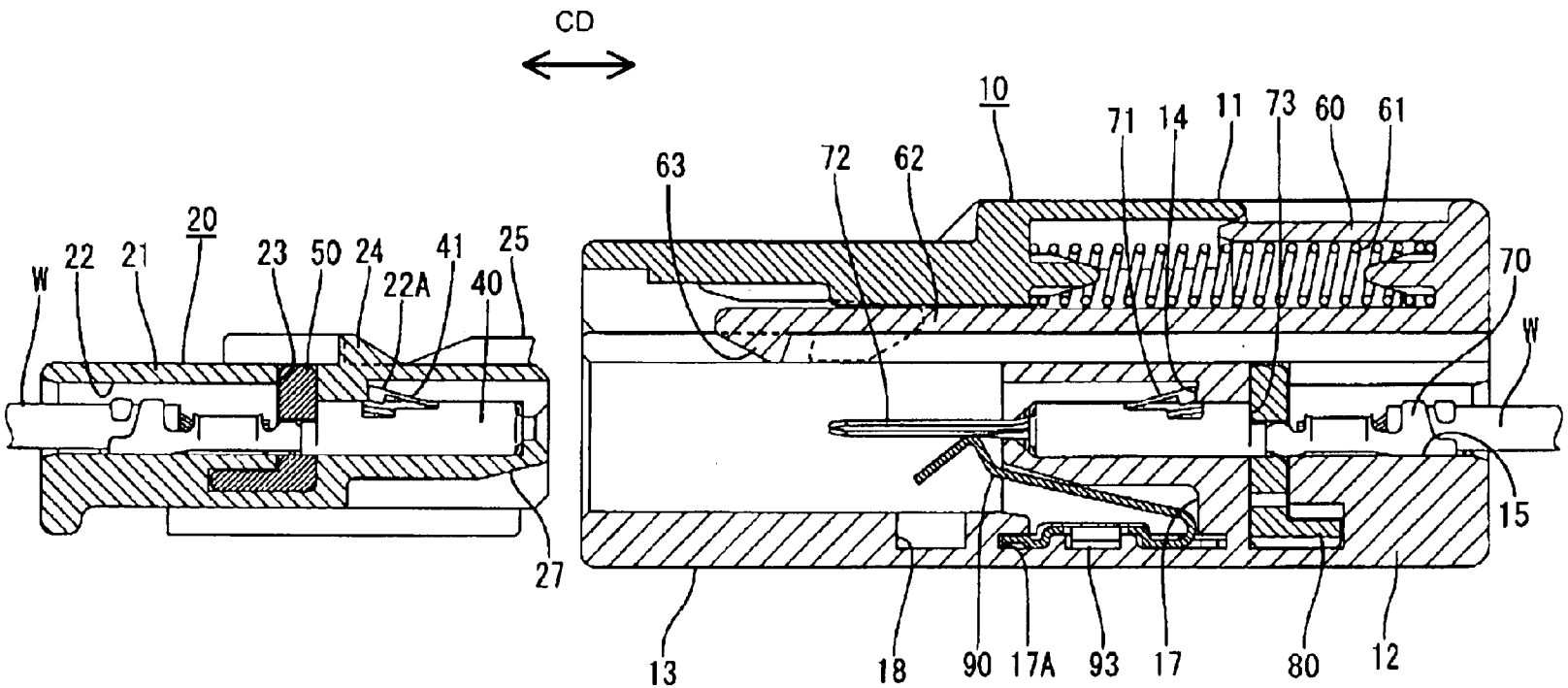
FIG. 1 is a side view in section showing a state before male and female connectors of a first embodiment of the invention are connected.

The female connector 20 has a substantially box shaped resin housing 21, as shown at left side of FIG. 1. Three side-by-side cavities 22 penetrate the female housing 21 along forward and backward directions and female terminal fittings 40 are insertable into the respective cavities 22 from behind. Each female terminal fitting 40 has a metal lock 41 that engages a stepped locking surface 22A on the inner surface of the cavity 22 to prevent the female terminal fitting 40 from coming out backward. A retainer mount hole 23 is formed in the upper surface of the female housing 21 and communicates with the cavities 22. A retainer 50 is mounted in the retainer mount hole 23 and locks the female terminal fittings 40. Left and right lock projections 24 are provided on the upper surface of the female housing 21, and a detecting projection 25 is provided in front of the lock projections 24.

The male connector 10 is shown at right side of FIG. 1, and has a male housing 11 made e.g. of a synthetic resin. The male housing 11 has a block shaped terminal accommodating portion 12 and a rectangular tubular receptacle 13 projects forward from a front part of the terminal accommodating portion 12. The female housing 21 fits into the receptacle 13 from the front.

A slider 60 is mounted on an upper part of the male housing 11 for preventing that the two connectors 10, 20 from being left only partly connected. A spring 61 biases the slider 60 towards a front position. The detecting projection 25 of the female housing 21 pushes the slider 60 to resiliently compress the spring 60 while the two connectors 10, 20 are being connected. The resilient force of the spring 61 returns the slider 60 substantially to its initial position when the connectors 10, 20 are connected properly. Specifically, the female housing 21 is pushed back by the accumulated resilient force of the spring 61 if the connecting operation is interrupted when the two connectors 10, 20 are only partly connected. Thus, the partly connected state of the two connectors 10, 20 can be detected. Left and right lock arms 62 cantilever forward on the slider 60. Each lock arm 62 has a claw 63 substantially at its leading end. The claws 63 engage resiliently with the corresponding lock projections 24 of the female housing 21 when the connectors 10, 20 are connected properly, thereby preventing the connectors 10, 20 from separating.

Three cavities 15 are formed substantially side-by-side in the terminal-accommodating portion 12 of the male housing 11, and male terminal fittings 70 are insertable into the cavities 15 from behind. Each male terminal fitting 70 has a metal lock 71 that engages a step 14 on the ceiling of each cavity 15. The male terminal fittings 70 have tabs 72 that project forward from the respective cavities 15 and into the receptacle 13. A retainer mount hole 16 is formed in one side surface of the terminal-accommodating portion 12.

Figure 7:
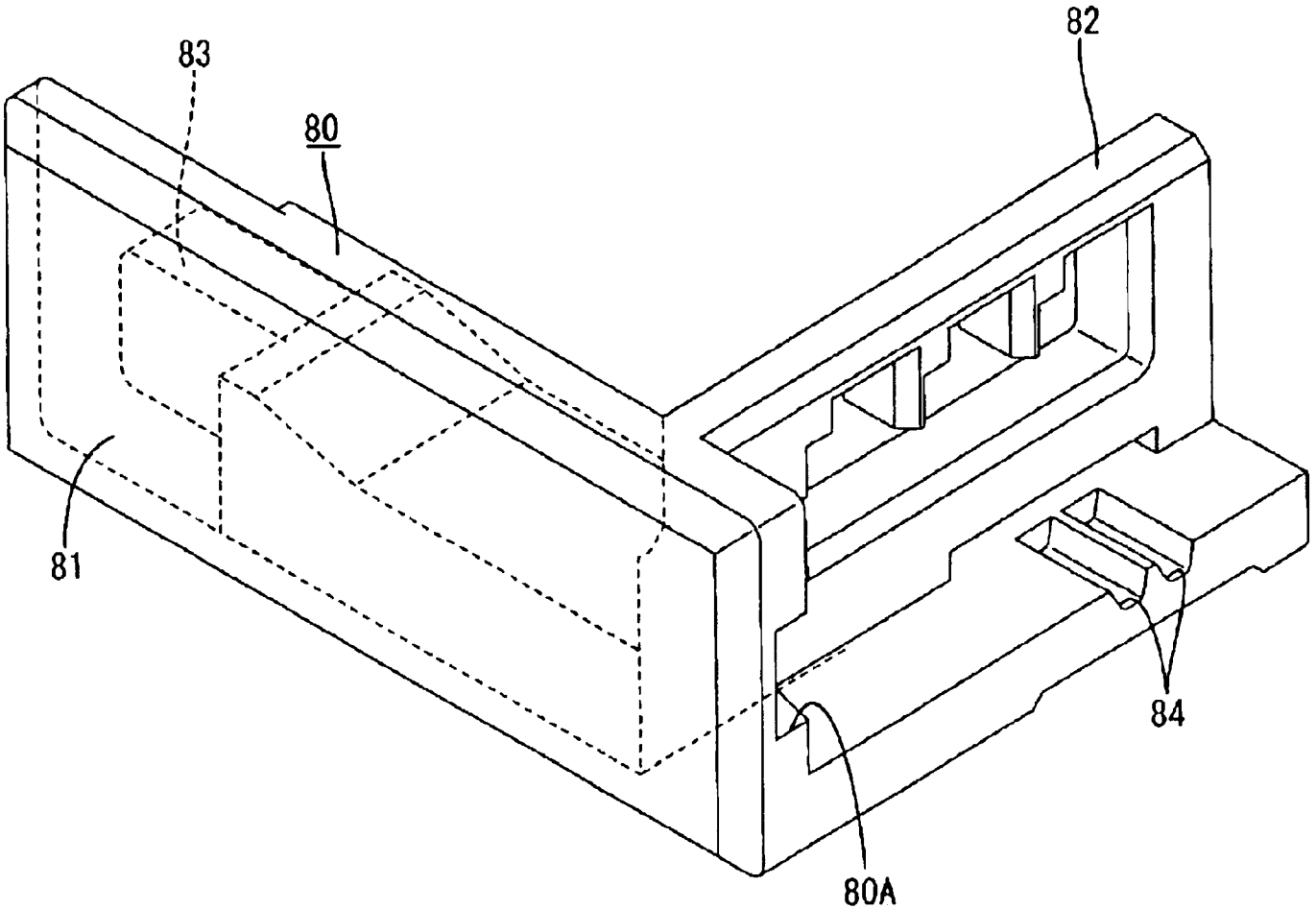
FIG. 7 is a perspective view of a retainer.

A retainer 80 can be mounted lightly in the retainer mount hole 16 at a first locking position where the male terminal fittings 70 can be inserted and withdrawn. The retainer 80 also can be mounted more deeply in the retainer mount hole 16 at a full locking position where the retainer 80 engages jaws 73 at the rear ends of the male terminal fittings 70 to lock the male terminal fittings 70. The retainer 80, as shown in FIG. 7, has a cover 81 for covering the retainer-mounting hole 16. A locking plate 82 projects from the cover 81 in a direction to cross the cavities 15, thereby forming parts of the respective cavities 15. A detector 83 extends forward from the front surface of the locking plate 82 along the cover 81 to project into the receptacle 13. The locking plate 82 has a substantially L-shaped cross section, and two engaging grooves 84 are formed substantially side-by-side in a part of the locking plate 82 that forms the bottom side of the L-shape. The engaging groove 84 farther from the cover 81 is engageable with a projection (not shown) in the terminal accommodating portion 12 to keep the retainer 80 at the first position. The engaging groove 84 closer to the cover 81 is engageable with the projection of the terminal-accommodating portion 12 to keep the retainer 80 at the second position.

Figure 5:
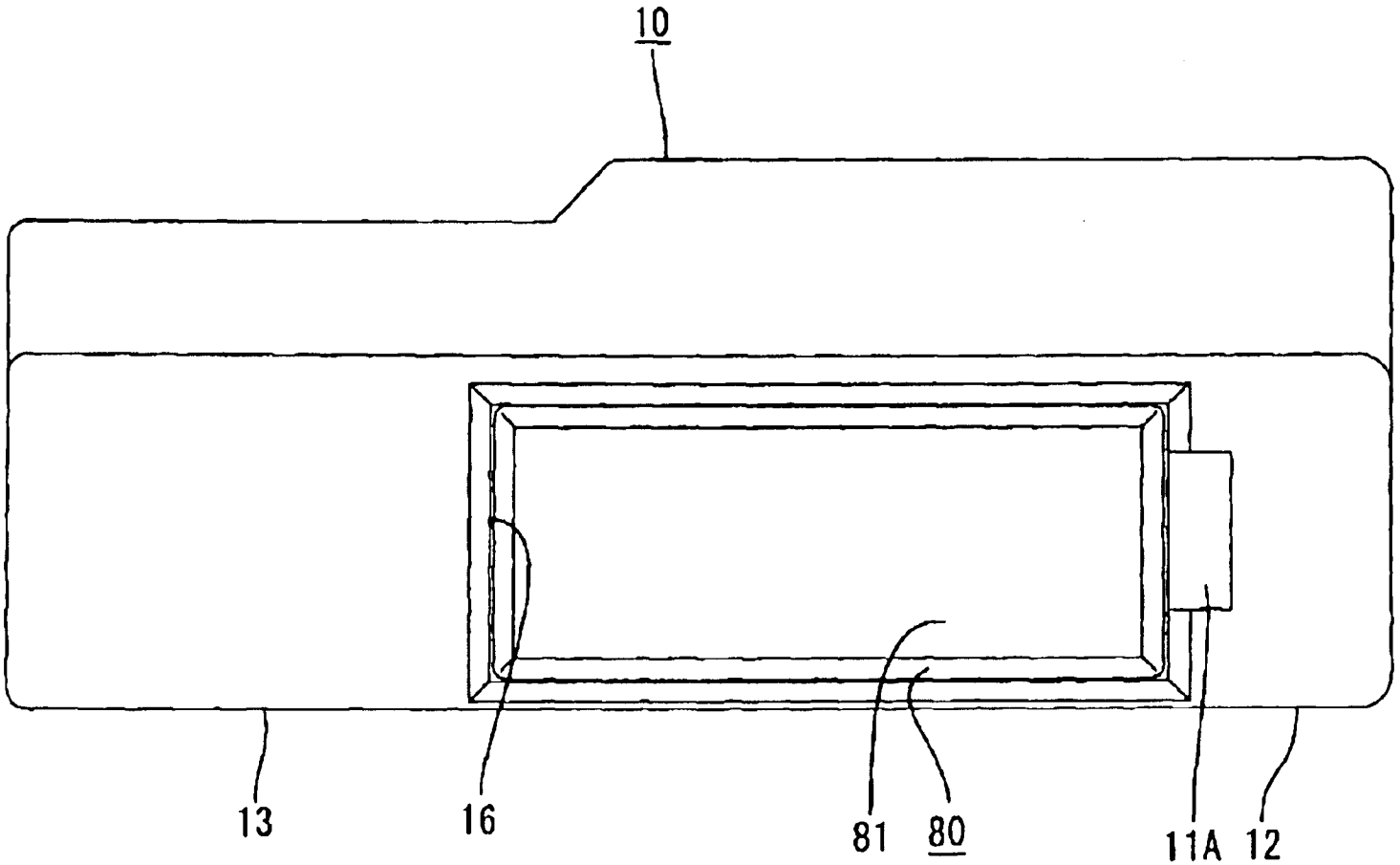
FIG. 5 is a side view of the male connector having a retainer mounted therein.

The detector 83 interferes with the female housing 21 to prevent connection of the two connectors 10, 20 when the retainer 80 is at the first position, whereas the detector 83 permits the female housing 21 to enter the receptacle 13 and ensures the connecting operation of the connectors 10, 20 when the retainer 80 is at the second position. A jig insertion groove 80A is cut in the inner surface of the rear end of the cover 81 by cutting, and a jig guiding groove 11A is cut at a position of the outer side surface at the opening edge of the retainer mount hole 16 corresponding to the jig insertion groove 80A, as shown in FIG. 5. The retainer 80 can be detached by inserting an unillustrated jig into the jig insertion groove 80A via the jig guiding groove 11A.

Figure 4:
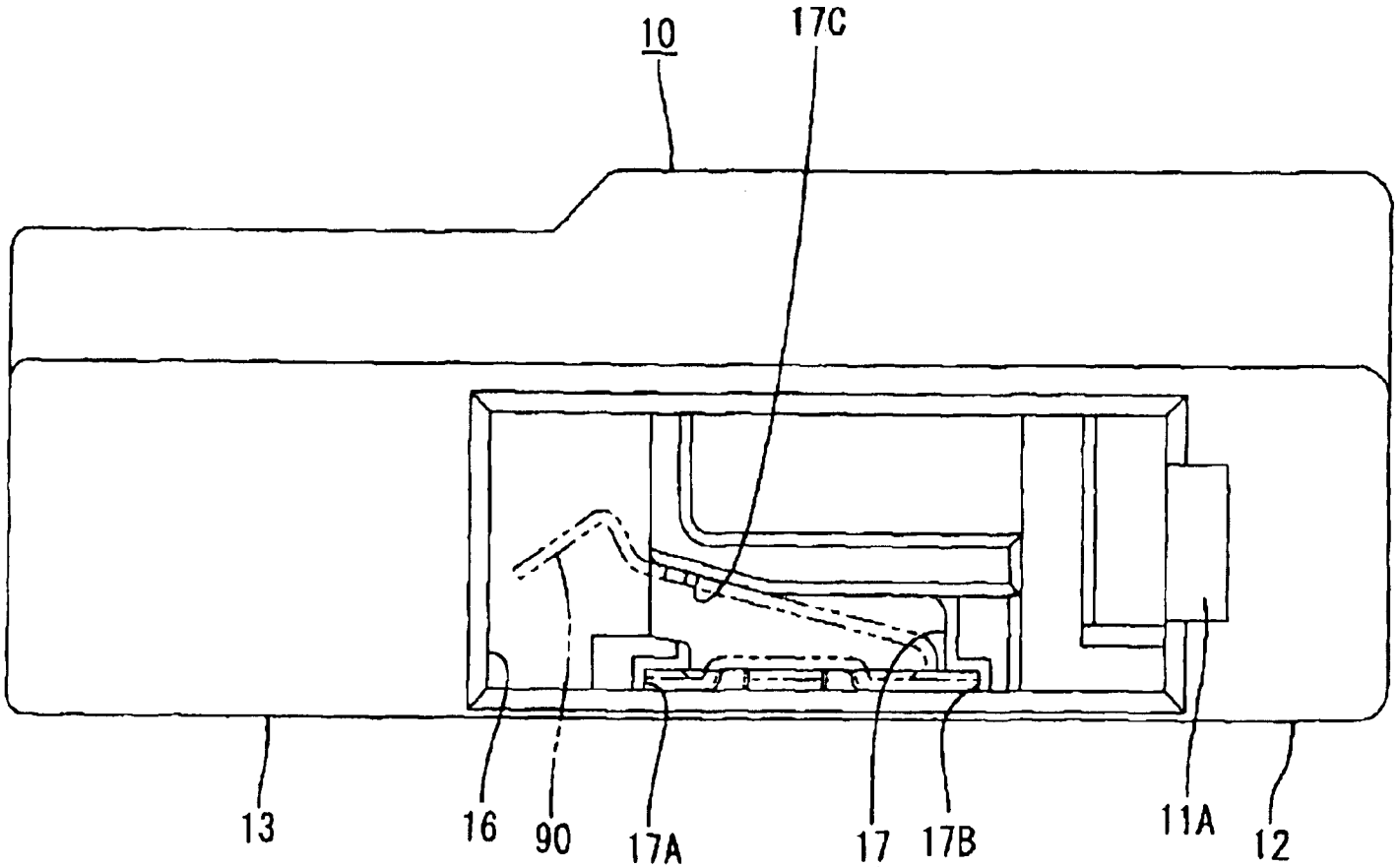
FIG. 4 is a side view of the male connector.

As shown in FIG. 4, the retainer mount hole 16 leaves a large rectangular opening in one side surface of the terminal accommodating portion 12, and a lateral side of the front part of the terminal-accommodating portion 12 faces the retainer mount hole 16. An accommodating chamber 17 is formed in the lateral side of the front part of the terminal-accommodating portion 12 and communicates with the retainer mount hole 16 and/or the receptacle 13 for accommodating a shorting terminal 90. The accommodating chamber 17 is shaped to correspond to the shorting terminal 90. First and second engaging portions 17A, 17B and a slanted portion 17C are formed in the inner surface of the accommodating chamber 17 for engaging and positioning the shorting terminal 90 with respect to forward and backward directions or the connecting direction CD. A slanted portion 17C also is in the inner surface of the accommodating chamber 17 and slopes up and in toward the front to accommodate shorting pieces 92 (described later) of the shorting terminal 90 in their oblique postures. The first engaging portion 17A is at the front end of the accommodating chamber 17 and opens back and towards the retainer mount hole 16. The second engaging portion 17B is at the rear end of the accommodating chamber 17 and open forward and towards the retainer mount hole 16. Thus, the first and second engaging portions 17A, 17B are guiding grooves extending substantially along the inserting direction ID of the shorting terminal 90.

Figure 6:
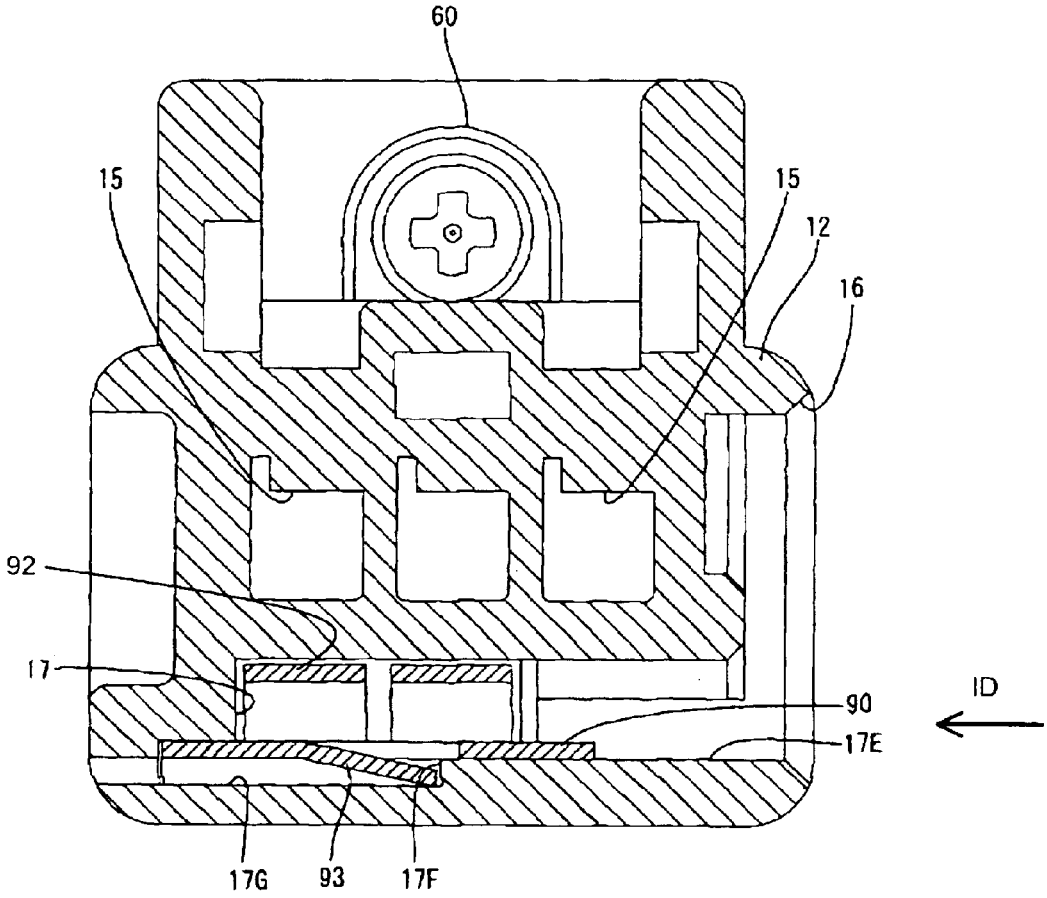
FIG. 6 is a longitudinal section of the male housing having a shorting terminal mounted therein.

As shown in FIG. 6, the accommodating chamber 17 is formed by boring the inside of the terminal accommodating portion 12 from the side surface where the retainer mount hole 16 is formed to a position near the opposite side surface. The shorting terminal 90 can be inserted in the inserting direction ID towards the opposite side surface. Thus, to form the accommodating chamber 17, it is sufficient to withdraw a mold corresponding to the shape of the accommodating chamber 17 from the retainer mount hole 16. Accordingly, the retainer mount hole 16 functions as a mold-removal hole.

A receiving portion 17E is provided in an intermediate position of the bottom surface of the accommodating chamber 17 with respect to the connecting direction CD and is raised into a trapezoidal cross section extending in the widthwise direction. The receiving portion 17E has a step 17F in an intermediate position of the terminal accommodating portion 12 as shown in FIG. 6, and a groove 17G extends from the step 17F towards the opposite side surface substantially along the inserting direction ID of the shorting terminal 90. The groove 17G receives a lock 93 (described later) of the shorting terminal 90, and the step 17F engages the lock 93 in the groove 17G to hinder the withdrawal of the lock 93. Thus, the shorting terminal 90 is held by the receiving portion so as not to come out of the accommodating chamber 17.

The shorting terminal 90 is formed by press-working a conductive metal plate and has a substantially flat base plate 94. At least two shorting pieces 92 are folded or bent at the rear end of the base plate 94 and extend obliquely forward along a longitudinal direction of the male terminal fittings 70. Moreover, the lock 93 is formed by bending a substantially U-shaped cut made substantially in the center of the base plate 94 to extend obliquely down in a direction opposite to the shorting pieces 92 with respect to an inserting direction ID into the accommodating chamber 17. The shorting pieces 92 are arranged at positions substantially corresponding to the respective male terminal fittings 70 inserted into the cavities 15 of the male housing 11, and are resiliently deformable with folds 95 coupled to the base plate 94 as supporting points of resiliently deformation. A deformation space is defined between the respective shorting pieces 92 and the base plate 94 for permitting resilient deformation of the shorting pieces 92.

Figure 2:
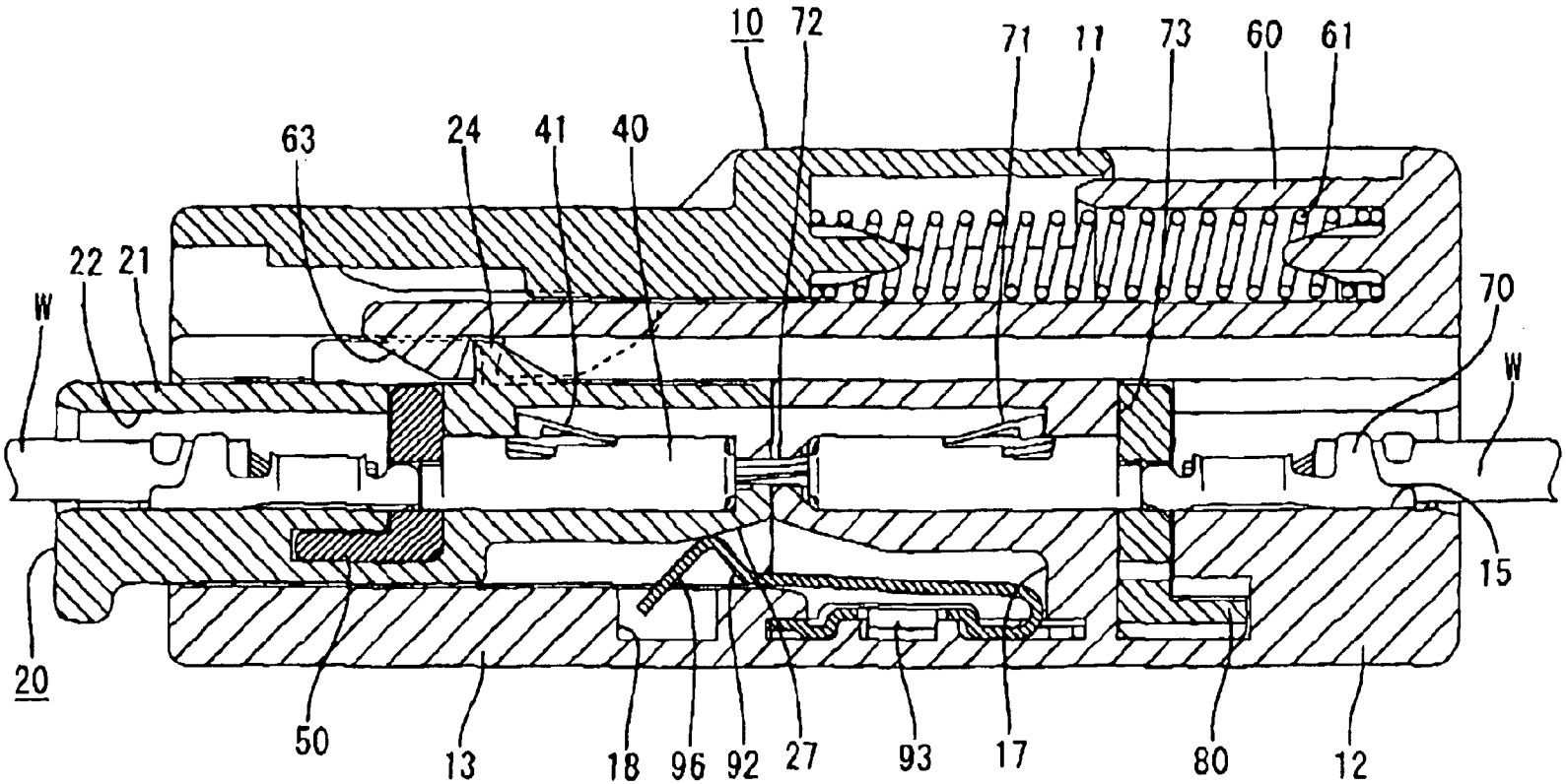
FIG. 2 is a side view in section showing a properly connected state of the connectors.
Figure 3:
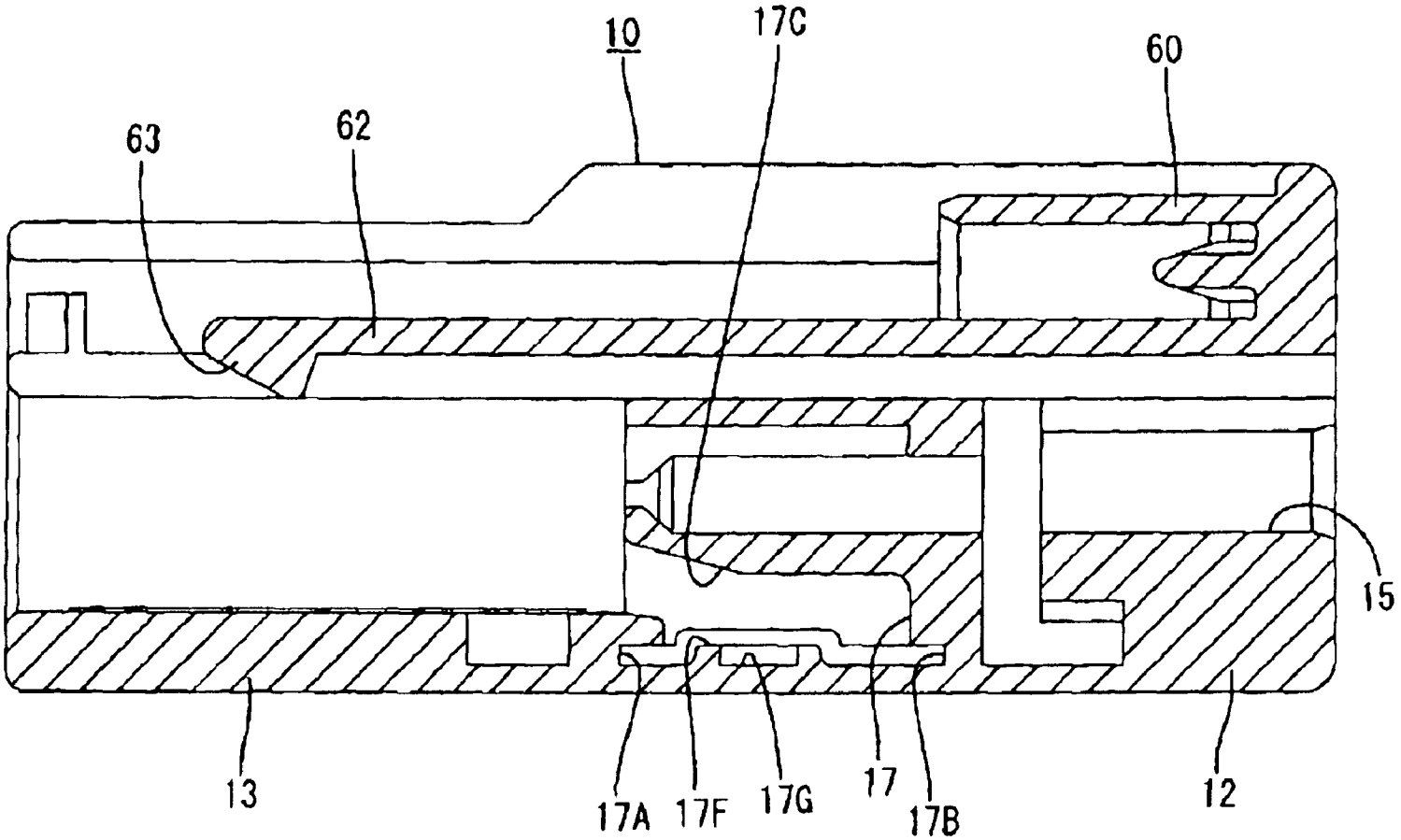
FIG. 3 is a side view in section of the male connector.

A top portion 96 of each shorting piece 92 is bent and can be brought resiliently into contact with the lower surface of the tab 72 of the corresponding male terminal fitting 70. The top portions 96 are brought resiliently into contact with the tabs 72 of two male terminal fittings 70 to be connected with an airbag device, thereby shorting the two male terminal fittings 70 and preventing a potential difference. The respective shorting pieces 92 are pressed down by a canceling portion 27 of the female housing 21 to cancel the shorting state when the two connectors 10, 20 are connected properly, as shown in FIG. 2. Escaping recesses 18 are formed in the inner bottom surface of the receptacle 13 of the male housing 11 for receiving the front ends of the top portions 96. Thus, the top portions 96 can be inclined smoothly down.

Figure 8:
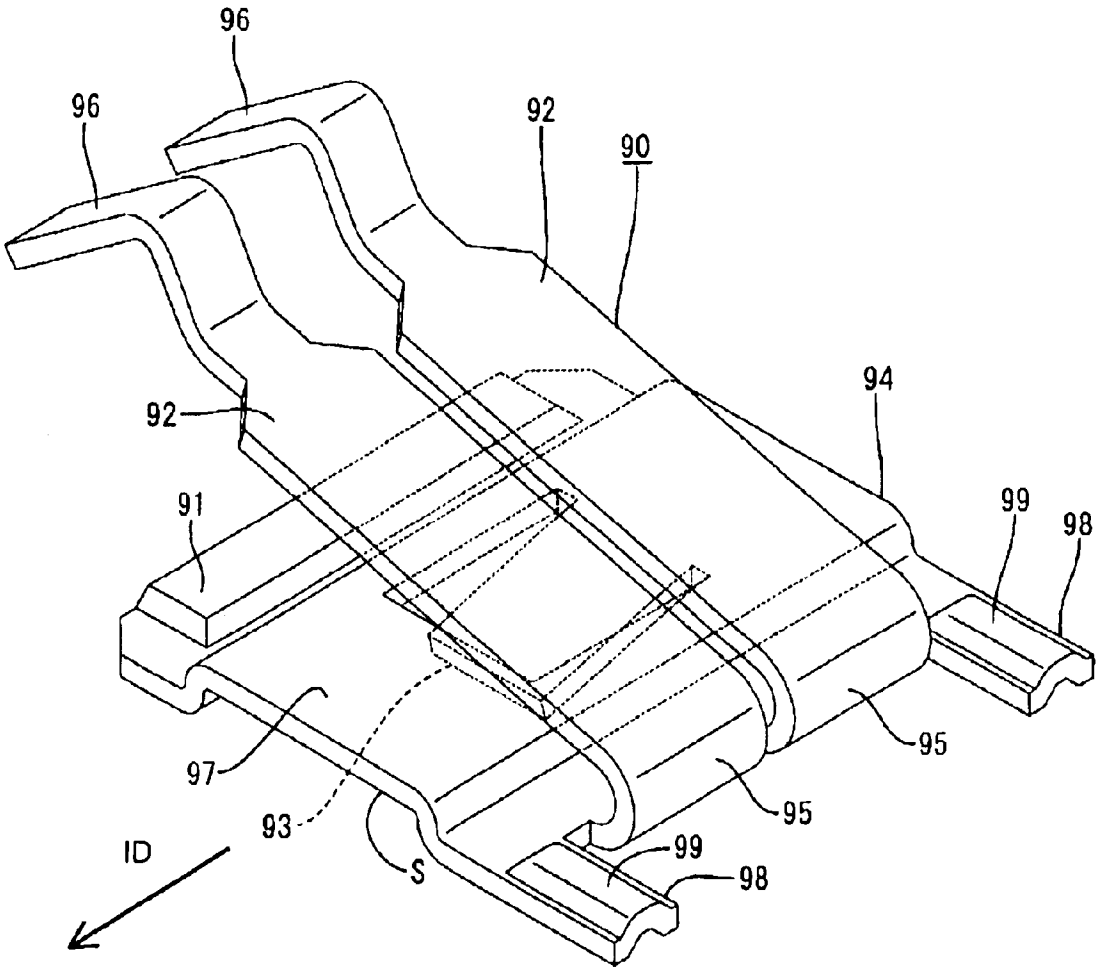
FIG. 8 is a perceptive view of the shorting terminal.

A crank-shaped elevated portion 97 is formed at an intermediate portion of the base plate 94 with respect to the connecting direction CD, as shown in FIG. 8. The elevated portion 97 is raised from the opposite ends of the base plate 94 by a distance corresponding to a projecting amount of the lock 93 from the base plate 94. Thus, the lock 93 projects into an elevation space S inside the elevated portion 97, and the receiving portion 17E enters the elevation space S to engage the elevated portion 97. A substantially trapezoidal engageable portion 91 is embossed at the front end of the base plate 94 and projects up on the side of the shorting pieces 92 to a position slightly lower than the elevated portion 97. Engageable pieces 98 project back along the connecting direction CD at opposite sides of the base plate 94 with the shorting pieces 92 located therebetween. Ribs 99 project over the entire length of the engageable pieces 98 along longitudinal direction. When the base plate 94 is accommodated into the accommodating chamber 17, the engageable portion 91 fits sideways along the inserting direction ID into the first engaging portion 17A and the engageable pieces 98 likewise fit sideways into the second engaging portion 17B. Accordingly, the shorting terminal 90 is positioned with respect to the connecting direction CD and the vertical direction by the first and second engaging portions 17A, 17B.

The male connector 10 is assembled by mounting the shorting terminal 90 along the inserting direction ID through the retainer mount hole 16 and into the accommodating chamber 17 of the male housing 11. Thus, the engageable portion 91 slides into the first engaging portion 17A and the engageable pieces 98 slide into the second engaging portion 17B. Additionally, the lock 93 of the shorting terminal 90 slides on the upper surface of the receiving portion 17E and deforms resiliently. The shorting terminal 90 is guided to the back of the accommodating chamber 17 in this state. The lock 93 is locked in the engaging groove 17G, as shown in FIG. 6, as the shorting pieces 92 reach their proper insertion positions.

The retainer 80 is mounted sideways to the first position in the retainer mount hole 16 of the male housing 11 after the shorting terminal 90 is mounted. The male terminal fittings 70 connected with wires W then are inserted into the cavities 15 of the male housing 11. The metal locks 71 engage the engaging portions 14 of the terminal-accommodating portion 12 when the male terminal fittings 70 reach their proper depths. At this time, the top portions 96 of the corresponding shorting pieces 92 resiliently contact the lower surfaces of the tabs 72 of the male terminal fittings 70 connected with the airbag device. As a result, the male terminal fittings 70 are shorted to create no potential difference between the male terminal fittings 70. The retainer 80 then is pushed to the full locking position to lock the male terminal fittings 70. The retainer 80 having reached the second position completely closes the retainer mount hole 16, as shown in FIG. 5. It does not matter which of the shorting terminal 90 and the male terminal fittings 70 are mounted first.

The female housing 21 then is fit into the receptacle 13 of the male housing 11, and the lock projections 24 of the female housing 21 engage resiliently with the claws 63 of the lock arms 62 of the male housing 11, as shown in FIG. 2. Thus, the male and female connectors 10, 20 are locked in their properly connected state and the female and male terminal fittings 40, 70 are connected electrically. The canceling portions 27 on the female housing 21 interact with the shorting pieces 92 as the two connectors 10, 20 are connected and disengage the shorting pieces 92 from the tabs 72. As a result, the airbag activating circuit is formed.

As described above, the shorting terminal 90 is inserted sideways into the accommodating chamber 17 through the retainer mount hole 16 and is engageable with the first and second engaging portions 17A, 17B. Thus, the shorting terminal 90 is positioned securely and is held without shaking forward, backward and vertically relative to the male housing 11. Further, the shorting terminal 90 is locked by the lock 93 and does not come out of the accommodating chamber 17.

The lock 93 is provided at the base plate 94 and projects towards a side opposite from the deformation space for permitting the resilient deformation of the shorting pieces 92. The height of the male connector 10 would be increased if the receiving portion 17E was provided at a position away from the deformation space by a distance corresponding to the projecting amount of the lock 93. However, in the present invention, the elevated portion 97 projects towards the deformation space; and the lock 93 projects into the elevation space S. In this way, the receiving portion 17E is raised towards the deformation space and, therefore, the height of the male connector 10 is not increased.

Further, the retainer 80 closes the retainer mount hole 16 and protects the shorting terminal 90 from external matter.

Figure 9A:
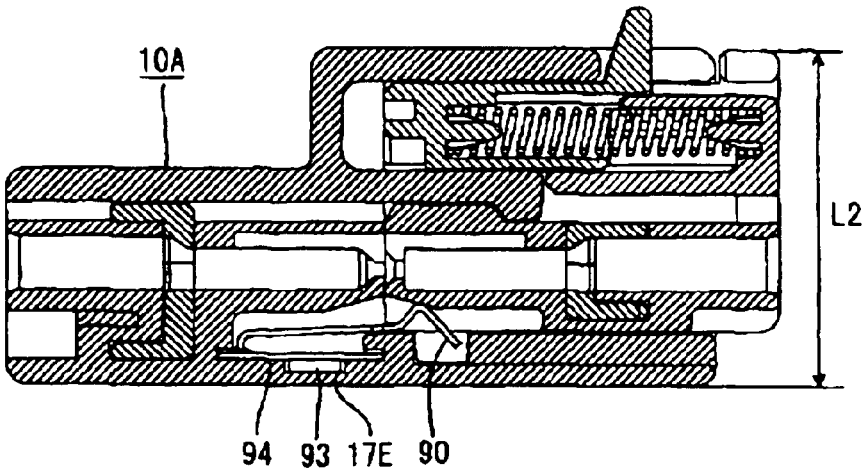
FIG. 9(A) is a side view in section showing a comparative example of a connector according to a second embodiment and FIG. 9(B) is a side view in section of the second embodiment.
Figure 9B:
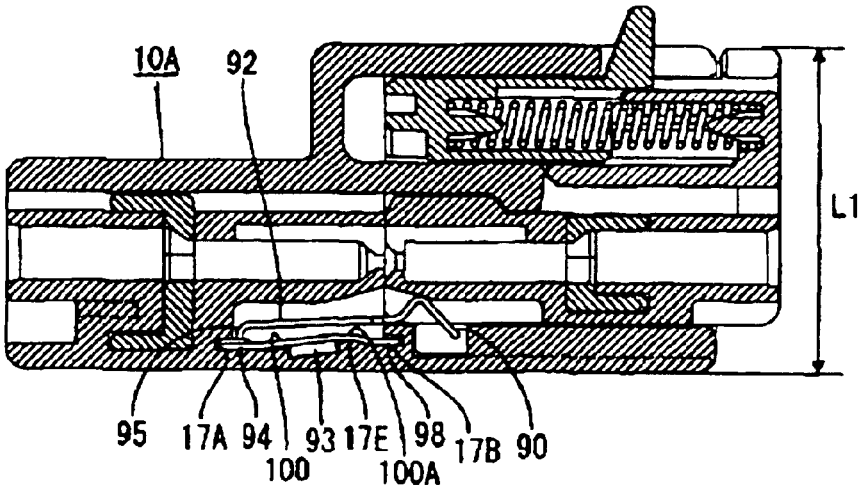
Figure 10:
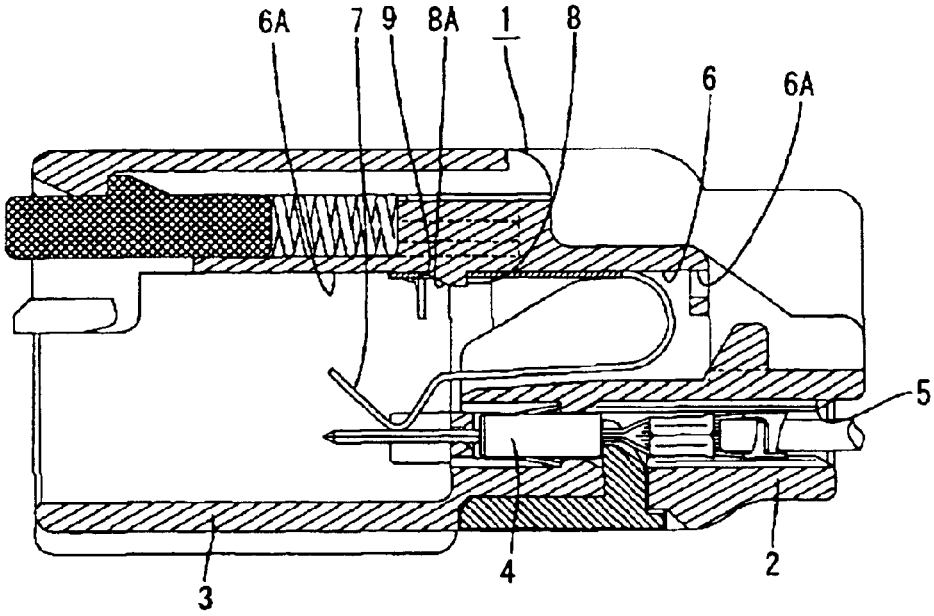
FIG. 10 PRIOR ART
FIG. 10 is a side view in section of a prior art connector.

FIG. 9(B) shows a second embodiment of the invention that is similar to the first embodiment in that the retainer mount hole 16 is formed in one side surface of the male housing 11. However, the first and second embodiments differ with respect to the structures of the base plate 94 of the shorting terminal 90 and the receiving portion 17E.

The shorting terminal 90 of the second embodiment has an inclined portion 100 sloped up and in towards the deformation space from one end of the base plate 94 toward the other end.

The inclined portion 100 has a tip 100A near the other end of the base plate 94 and has the lock 93 formed at an intermediate position. An engageable piece 98 extends substantially horizontally along the connecting direction CD from the tip 100A to the other end of the base plate 94.

The receiving portion 17E is sloped up and in towards the male terminal fitting 70 along the inclined portion 100. Further, the second engaging portion 17B is slightly higher than the first engaging portion 17A substantially in conformity with the inclination of the inclined portion 100.

FIG. 9(A) shows a comparative example in which the base plate 94 is flat without having the inclined portion 100. The lock 93 projects towards the side opposite from the deformation space from the same height position as the one end of the base plate 94. Thus, the receiving portion 17E for receiving the lock 93 is farther from the deformation space. As a result, the height of the male connector 10 is increased.

Contrary to this, the deformation space of the second embodiment shown in FIG. 9(B) is dead space and the inclined portion 100 slopes up towards the deformation space. Thus, the receiving portion 17E is raised towards the deformation space to follow the lock 93 at the inclined portion 100 and the height of the male connector 10 is suppressed. In other words, height L1 of the male connector 10 shown in FIG. 9(B) is smaller than height L2 of a male connector 10A shown in FIG. 9(A) by as much as the receiving portion 17E is raised (L1<L2).

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The shorting terminal has the cantilevered shorting pieces in the foregoing embodiments. However, the shorting terminal may include, for example, shorting pieces supported at both ends. Further, the metal plate may be embossed to form contact points with the tabs.

The receiving portion is fit into the elevation space of the elevated portion to engage the elevated portion in the foregoing embodiments. However, the receiving portion may merely fit into the elevation space of the elevated portion according to the invention.

The slider is not required according to the present invention.

The retainer closes the retainer mount hole in the foregoing embodiments. However, a portion of the retainer mount hole may be merely a window. Further, a lid other than the retainer may close the window.

Although the shorting terminal is mounted into the male housing in the foregoing embodiment, the invention is also applicable to a case where a shorting terminal is mounted into a female housing.

What is claimed is:

1. A connector, comprising:

a housing, cavities extending through the housing along a connecting direction, the housing having a side surface formed with a window, an accommodating chamber formed in the housing and communicating with both the window and the cavities, front and rear positioning grooves formed in the accommodating chamber and extending along an inserting direction transverse to the connecting direction;

terminal fittings inserted into the respective cavities along the connecting direction; and a shorting terminal inserted along the inserting direction into the accommodating chamber and biased into shorting contact with the terminal fittings, the shorting terminal having front and rear engageable pieces aligned with and slid through the window and into the respective front and rear positioning grooves for positioning the shorting terminal at front and rear positions at least with respect to the connecting direction.

2. The connector of claim 1, further comprising a retainer being insertable along the inserting direction through the window and into a position for locking the terminal fittings in the cavities.

3. The connector of claim 2, wherein the retainer has a lid for substantially closing the window.

4. The connector of claim 3, wherein the shorting terminal has a base plate, shorting pieces extending from the base plate towards the terminal fittings, a deformation space between the shorting pieces and the base plate, and a resiliently deformable lock projecting from the base plate away from the deformation space and oblique to the inserting direction.

5. The connector of claim 4, wherein the base plate has an elevated portion projecting towards the deformation space, and the lock projects into an elevation space inside the elevated portion.

6. The connector of claim 4, wherein a receiving portion is provided on an inner surface of the accommodating chamber of the housing for engaging and locking the lock.

7. The connector of claim 6, wherein the lock of the shorting terminal is resiliently deformed and slides on the receiving portion upon inserting the shorting terminal in the accommodating space.

8. The connector of claim 7, wherein the base plate has an inclined portion sloped towards the deformation space, the lock being provided at the inclined portion, and the receiving portion is provided along the inclined portion.

9. A connector system, comprising: a first connector having a housing, cavities extending through the housing along a connecting direction, the housing having a side surface formed with a window, an accommodating chamber formed in the housing and communicating with the window and with the cavities, front and rear positioning grooves formed in the accommodating chamber and extending along an inserting direction transverse to the connecting direction, terminal fittings inserted into the respective cavities, and a shorting terminal inserted along the inserting direction through the window and into the accommodating chamber, the shorting terminal being biased into shorting contact with the terminal fittings, the shorting terminal having front and rear engageable pieces that are alignable with and slidable through the window and into the respective front and rear positioning grooves for positioning the shorting terminal at front and rear positions at least with respect to the connecting direction; and a second connector connectable with the first connector, the second connector having at least one canceling portion for deflecting the shorting terminal away from the terminal fittings and thereby canceling a shorted state of the terminal fittings when the connectors are connected properly.

* * * * *